United States Patent [19]

Hamada et al.

[11] Patent Number: 5,014,035

[45] Date of Patent: May 7, 1991

[54] BIMETALLIC CIRCUIT BREAKER WITH INSULATED TERMINAL ASSEMBLY

[75] Inventors: Yonenori Hamada; Eiji Senbokuya, both of Yokohama, Japan

[73] Assignees: Jidosha Denki Kogyo K.K.; Yugen Kaisha Senbokuya, both of Kanagawa, Japan

[21] Appl. No.: 465,861

[22] Filed: Jan. 16, 1990

[30] Foreign Application Priority Data

Jan. 17, 1989 [JP] Japan ..... 1-3595[U]

[51] Int. Cl.[5] ..... H01H 37/04; H01H 37/52

[52] U.S. Cl. ..... 337/372; 337/365; 337/380

[58] Field of Search ..... 337/372, 365, 380

[56] References Cited

U.S. PATENT DOCUMENTS 4,151,501 4/1979 Taylor ..... 337/372

*Primary Examiner*—Harold Broome

*Attorney, Agent, or Firm*—Sughrue, Mion, Zinn, Macpeak & Seas

[57] ABSTRACT

A circuit breaker is provided with a first conductive plate fixed with a bimetal attached with a moving contact, a second conductive plate attached with a fixed contact and an insulator lying between base parts of the both conductive plates and fixed by bending either base part of said both conductive plates around said insulator. It is possible to facilitate the automatic assembly without adopting the insert molding process even when miniaturized.

6 Claims, 4 Drawing Sheets

BIMETALLIC CIRCUIT BREAKER WITH INSULATED TERMINAL ASSEMBLY

BACKGROUND OF THE INVENTION

1. Field Of The Invention

The invention relates to a circuit breaker used for protecting an electric apparatus and a circuit from an overcurrent by maintaining the electric power supply to the electric apparatus while a normal current flows in the circuit and cutting off the power supply when an overcurrent flows in the circuit.

2. Description Of The Prior Art

There has been used a circuit breaker having structure as shown in FIG. 8 for example.

A circuit breaker 101 shown in FIG. 8 is provided with a first conductive plate 105 having a connecting terminal 102 and a base part 104 fixed with a bimetal 103 by spot welding (at the position marked in the figure with "X"), and with a second conductive plate 112 having a connecting terminal 110 and a terminal 111 attached with a fixed contact 111*a* contacting with or discontact from a moving contact 103*a* attached to said bimetal 103. And the base part 104 of said first conductive plate 105 and the second conductive plate 112 are formed in one body together with an insulator 113 by insert molding process.

In the circuit breaker 101, when an overcurrent flows in the bimetal 103, the moving contact 103*a* provided to said bimetal 103 is disconnected from the fixed contact 111*a* by the thermal deformation of said bimetal 103. Thereby, the electric power supply to the electric apparatus is cut off, the electric apparatus and the circuit are protected from the burning out caused by the overcurrent. And when the bimetal return to its original shape by the thermal drop during the interception of the power supply, said moving contact 103*a* comes in contact with the fixed contact 111*a* and the power supply to the electric apparatus is resumed. Hereupon, said circuit breaker 101 of the cycle type is so designed that an effective current descreases to the value lower than the burning current of the electric apparatus while the interception of the power supply caused by the overcurrent and the resumption by the thermal drop of the bimetal are repeated alternately, therefore it serves to prevent the electric apparatus and the circuit from the burning out. Additionally, said circuit breaker 101 is not actuated by a normal load current.

In the case of housing the circuit breaker on the inside of the electric apparatus such as a wiper motor or the like, it is necessary to miniaturize the circuit breaker in order to facilitate the housing. However, in the conventional circuit breaker 101 which is formed in one body by uniting the both conductive plates 105 and 112 together with the insulator 113 using the process of insert molding as described above, there is a problem in that the assembling operationability becomes worse owing to the miniaturization of the respective members of said circuit breaker.

SUMMARY OF THE INVENTION

This invention is made in view of above mentioned problem of the prior art, it is an object to provide a circuit breaker which is possible to fix the conductive plates easily without using the insert molding process, good in the operationability and possible to facilitate the automatic assembly even when miniaturized.

The construction of the circuit breaker according to this invention for attaining the above mentioned object is characterized by comprising a bimetal provided with a moving contact and for breaking a circuit by its thermal deformation caused by an overcurrent, a first conductive plate having a base part fixed with said bimetal, a second conductive plate having a base part and provided with a fixed contact contacting with or discontacting from said moving contact according to a displacement of said bimetal, and an insulator lying between the base parts of the both conductive plates and fixed by bending either base part of said both conductive plates so as to enclose said insulator.

The circuit breaker according to this invention is provided with the insulator between the base plate of the first conductive plate and the base plate of the second conductive plate, said insulator is fixed between said both base plates by bending either base part of said both conductive plates and enclosing the insulator, and the respective base parts of the first and second conductive plates are isolated by said insulator. Therefore, said circuit breaker is so designed as to be manufactured by the simplified process under the good operation efficiency.

DESCRIPTION OF THE PREFERRED EMBODIMENT

This invention will be described below on basis of drawings.

Figure 1:
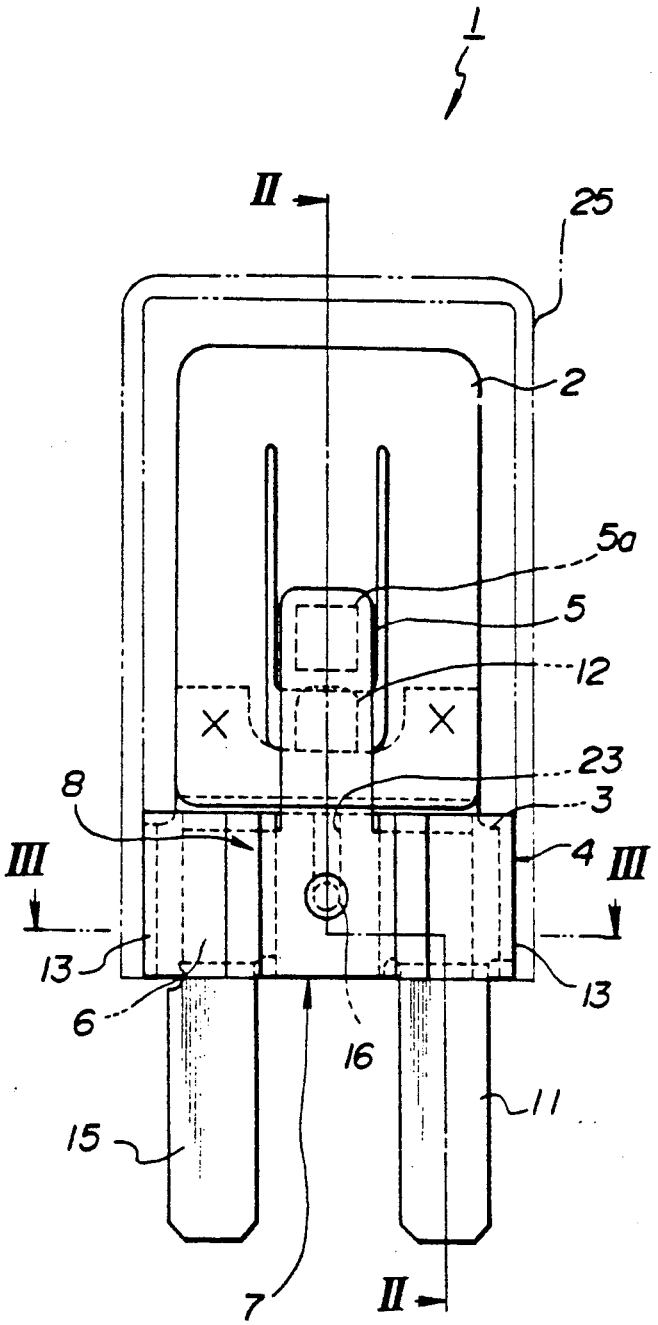
FIG. 1 is a front view illustrating an embodiment of the circuit breaker according to this invention.
Figure 2:
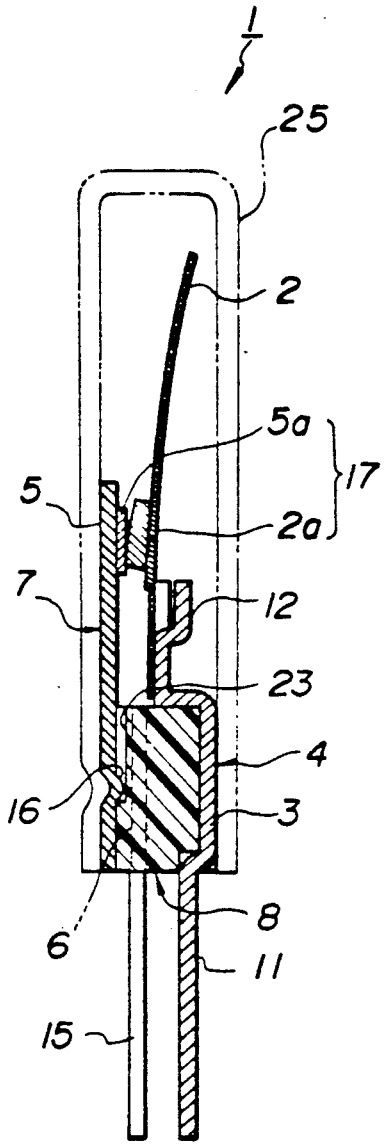
FIG. 2 is a sectional view along section lines II—II of FIG. 1.

FIG. 1 to FIG. 5 are drawings to explain an embodiment of the circuit breaker according to this invention, FIG. 2 shows a front view of the circuit breaker and FIG. 2 shows a sectional structure of said circuit breaker.

As shown in FIG. 1 and FIG. 2, the circuit breaker 1 is constituted with a first conductive plate 4 having a base part 3 fixed with an E-shaped bimetal 2 by spot welding (at the position marked with "X" in the figure), a second conductive plate 7 provided to the base part 6 with a terminal 5 attached with a fixed contact 5*a* in or out of contact with a moving contact 2*a* of said bimetal 2 and an insulative resinous base 8 fixed between the base part 3 and 6 of the first conductive plate 4 and the second conductive plate 7 and isolating the base part 3 of said first conductive plate 4 from the base plate 6 of the second conductive plate 7.

Figure 3:
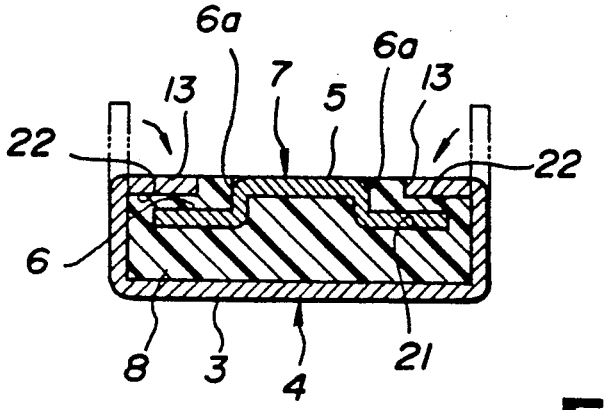
FIG. 3 is a sectional view along section lines III—III of FIG. 1.
Figure 4:
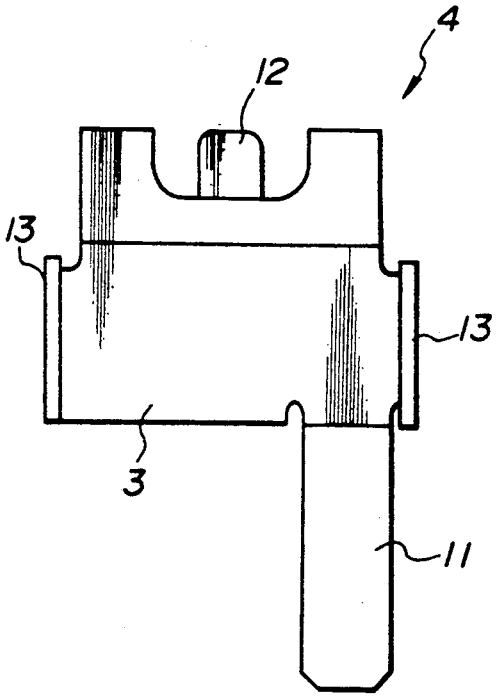
FIG. 4 is a front view illustrating the first conductive plate of the circuit breaker shown in FIG. 1.

Said first conductive plate 4, as also shown in FIG. 4, has the base part 3 as mentioned above, in this embodiment said base part 3 is provided with a connecting terminal 11, a stopper 12 for restricting a superflous movement of the moving contact 2a attached to the bimetal 2, and with lug plates 13 and 13 for bending on the respective end side in FIG. 4. And said first conductive plate 4 is formed by press working, and is so designed as to be fixed to the resinous base 8 by bending the lug plates 13 and 13 on said resinous base 8 surroundingly as shown in FIG. 3.

Figure 5:
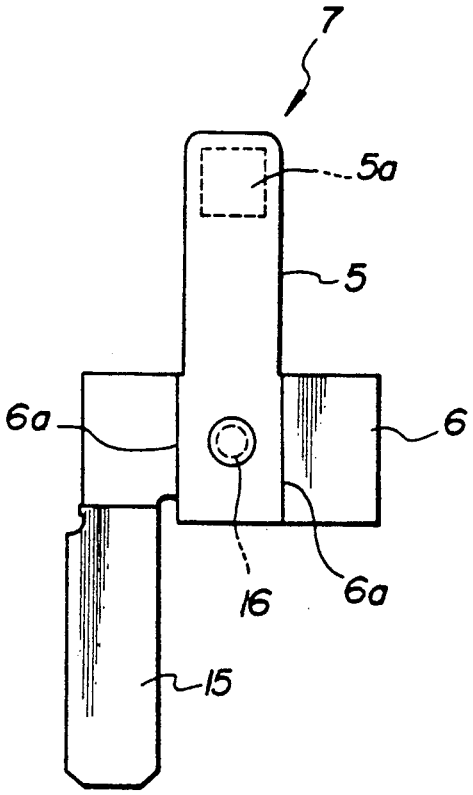
FIG. 5 is a front view illustrating the second conductive plate of the circuit breaker shown in FIG. 1.

Said second conductive plate 7, as also shown in FIG. 5 has the base part 6 as mentioned above, said base part is provided with said terminal 5 attached with the fixed contact 5a, a connecting terminal 15 and a projection 16 for facilitating the fitting in the resinous base 8. Said second conductive plate 7 is provided with step-shaped parts 6a and 6a between the terminal 5 and the base part 6 by bending both end parts of the base part 6 in FIG. 6. And a switching portion 17 for supplying an electric power to the electric apparatus and cutting off the supply of the power, consists of the moving contact 2a of said bimetal 2 and the fixed contact 5a of the second conductive plate 7.

Said resinous base 8, as also shown in FIG. 3 is provided with a crooked groove 21 for attaching the terminal 5 by fitting the base part 6 having step-shaped parts 6a and 6a of said second conductive plate 7, stepped parts 22 and 22 for receiving the lug plates 13 and 13 provided to the base part 3 of said first conductive plate 4 at the time of bending said lug plates 13 and 13, and a guide groove 23 for positioning the second conductive plate 7 in the groove 21 by fitting with the projection 16 of said second conductive plate 7.

Nextly, a way to assemble the circuit breaker 1 having the afore mentioned construction will be explained below.

First of all, the base part 6 of the second conductive plate 7 is fitted into the groove 21 of the resinous base 8 molded in advance. Thereupon, the second conductive plate 7 is positioned in the resinous base 8 by fitting the projection 16 of the second conductive plate 7 into the guide groove 23 of the resinous base 8 and inserting the second conductive plate 7 using an automatic assembly apparatus or the like until said projection 16 of the second conductive plate 7 comes in contact with the end of said guide groove 23. Therefore, it is not necessary to use a jig for positioning.

Subsequently, above mentioned resinous base 8 is placed on the base part 3 of the first conductive plate 4. In this state, the lug plates 13 and 13 provided to the base part 3 of the first conductive plate 4 are bent in the direction shown with the arrow in FIG. 3 and made in contact with the stepped parts 22 and 22 of the resinous base 8 by the press machine or the like. And the assembly is completed after fixing the bimetal 2 to the base part 3 of the first conductive plate 4 by spot welding.

Accordingly, respective base parts 3 and 6 of the first conductive plate 4 and the second conductive plate 7 are never contact electrically each other because the resinous base 8 is fixed between the base part 3 of the first conductive plate 4 and the base part 6 of the second conductive plate 7.

Additionally, at a case of housing said circuit breaker 1 in a case 25, the case 25 is fixed to the circuit breaker 1 by deforming the case 25 so as to coinside with the recess on the reverse side of the projection 16 of the second conductive plate 7 by heating or the like, after containing the circuit breaker 1 in the case 25 shown in FIGS. 1 and 2 with two-dot chain lines.

Figure 6:
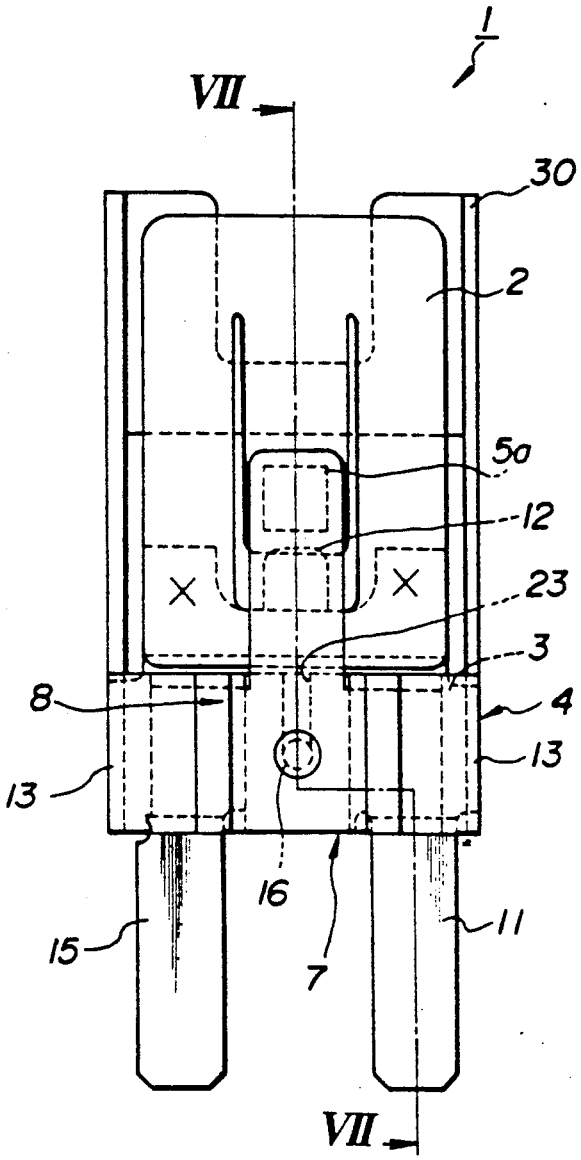
FIG. 6 is a front view illustrating another embodiment of the circuit breaker according to this invention.
Figure 7:
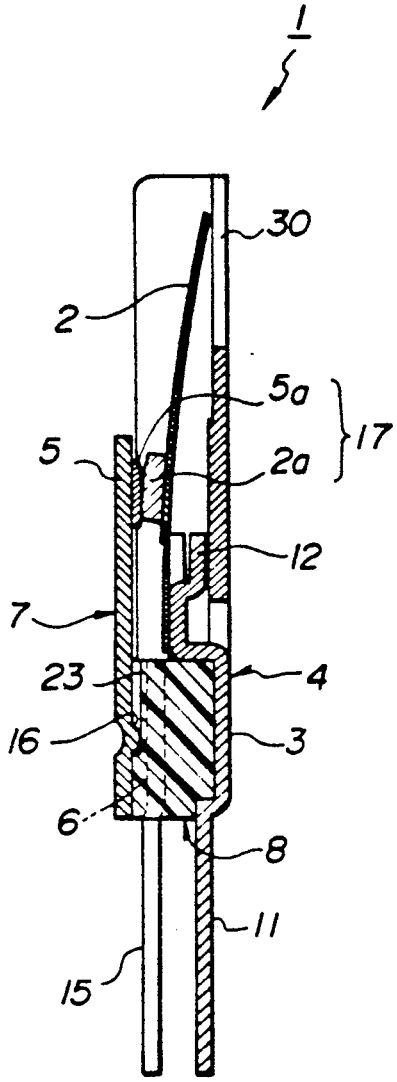
FIG. 7 is a sectional view along section lines VII—VII of FIG. 6.
Figure 8:
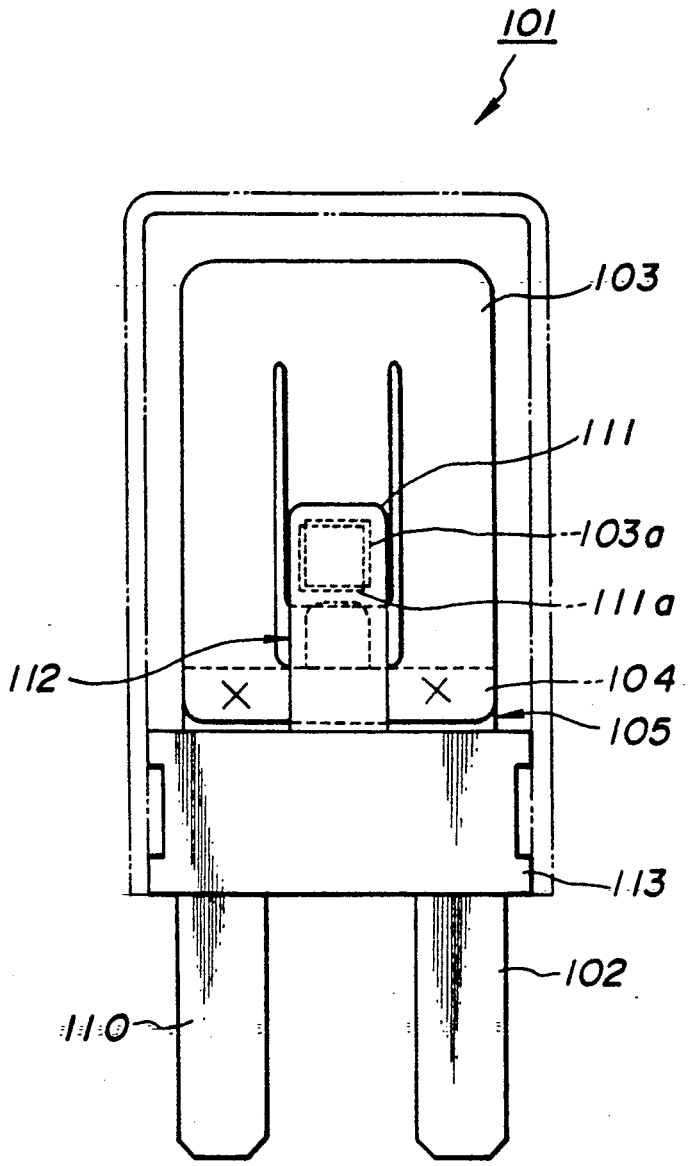
FIG. 8 (PRIOR ART)
FIG. 8 is a front view illustrating a conventional circuit breaker.

FIG. 6 and FIG. 7 are drawings to explain another embodiment of the circuit breaker according to this invention. In this embodiment, the circuit breaker 1 is so designed as to protect the bimetal 2 by providing a protection plate 30 extended from the first conductive plate 4, and has the same structure as the afore mentioned embodiment excepting the protection plate 30. Additionally, also in this embodiment, the circuit breaker 1 may be housed in the case 25 by engaging a projection provided to the inner face of the case 25 with the recess on the reverse side of the projection 16 if necessary.

Furthermore, in the above mentioned embodiments, the circuit breakers 1 have been explained which have structures that the resinous base 8 is fixed between the base part 3 of the first conductive plate 4 and the base part 6 of the second conductive plate 6 by bending the lug plates 13 and 13 of the first conductive plate 4 round the resinous base 8 after putting the second conductive plate 7 into the resinous base 8 formed by molding, but a flat-shaped insulative sheet may be fixed between a flat-shaped base part of the first conductive plate and a flat-shaped base part of the second conductive plate as a substitute for the molded resinous base 8.

As mentioned above, the circuit breaker according to this invention comprises a bimetal provided with a moving contact and for breaking a circuit by its thermal deformation caused by an overcurrent, a first conductive plate having a base part fixed with said bimetal, a second conductive plate having a base part and provided with a fixed contact contacting with or discontacting from said moving contact according to a displacement of said bimetal; and an insulator lying between the base parts of the both conductive plates and fixed bt bending either base part of said both conductive plates so as to enclose said insulator. Therefore, it is possible to fix easily either base part of the both conductive plates through the insulator with another base part of the both conductive plates by bending another base part and enclosing the insulator, and possible to be adopt for automatic assembly without deterioration in the assembling workability even if miniaturized. Accordingly, excellent effects are obtained since it is possible to assemble without adopting the insert molding process and reduce the production cost.

What is claimed is:

1. A circuit breaker comprising:

an E-shaped bimetal having a central portion provided with a movable contact and end portions on both sides of said central portion;

a first conductive plate having a base part fixed to said E-shaped bimetal and having a connecting terminal protruding from said base part in a direction opposite from said bimetal;

a second conductive plate having a base part provided with a support having a fixed contact thereon in a position opposed to said movable contact on said central portion of said bimetal and provided with a connecting terminal protruding from said base part in a direction opposite from said support; and insulator means disposed between said first and second conductive plates with said second conductive plate being secured in said insulator means by a pair of lug plates on said first conductive plate which are wrapped around said insulating means.

2. A circuit breaker as set forth in claim 1 wherein said insulator means is provided with a groove for receiving said second conductive plate.

3. A circuit breaker as set forth in claim 2 wherein said second conductive plate is provided with a projection and said insulator means is provided with a guide groove for guiding said second conductive plate into a proper mounting position by receiving said projection on said second conductive plate.

4. A circuit breaker as set forth in claim 3 wherein said insulator means is provided with stepped portions for receiving said lug plates on said first conductive plate.

5. A circuit breaker as set forth in claim 4 further comprising a case having a prominence for fitting into a recess on a reverse side of said projection on said second conductive plate.

6. A circuit breaker as set forth in claim 4 wherein said first conductive plate is provided with a protection plate protruding therefrom.

* * * * *